US010707609B2

(12) United States Patent
Inoue

(10) Patent No.: US 10,707,609 B2
(45) Date of Patent: Jul. 7, 2020

(54) CONNECTOR

(71) Applicant: Sumitomo Wiring Systems, Ltd., Yokkaichi, Mie (JP)

(72) Inventor: Yuta Inoue, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/190,490

(22) Filed: Nov. 14, 2018

(65) Prior Publication Data

US 2019/0173224 A1 Jun. 6, 2019

(30) Foreign Application Priority Data

Dec. 5, 2017 (JP) ..... 2017-233825

(51) Int. Cl.

| | |
|---|---|
| ***H01R 13/52*** | (2006.01) |
| ***H01R 27/02*** | (2006.01) |
| *H01R 107/00* | (2006.01) |
| *H01R 31/06* | (2006.01) |
| *H01R 13/74* | (2006.01) |

(52) U.S. Cl.

CPC ..... *H01R 13/5219* (2013.01); *H01R 27/02* (2013.01); *H01R 13/5216* (2013.01); *H01R 13/748* (2013.01); *H01R 31/06* (2013.01); *H01R 2107/00* (2013.01); *H01R 2201/26* (2013.01)

(58) Field of Classification Search

CPC ..... H01R 13/52; H01R 30/022; H01R 27/02; H01R 13/521; H01R 13/5216; H01R 13/5219; H01R 13/523

See application file for complete search history.

(56) References Cited

U.S. PATENT DOCUMENTS

| | | | | |
|---|---|---|---|---|
| 8,939,734 | B2 * | 1/2015 | Hoying | F04B 39/121 417/410.1 |
| 10,027,051 | B1 * | 7/2018 | Manushi | H01R 43/24 |
| 10,044,122 | B2 * | 8/2018 | Liskow | H01R 12/55 |
| 2005/0048848 | A1 * | 3/2005 | Axenbock | H01R 13/2421 439/700 |
| 2005/0202720 | A1 * | 9/2005 | Burke | B29C 45/14639 439/578 |
| 2011/0086525 | A1 * | 4/2011 | Begemann | H01R 12/57 439/83 |

(Continued)

FOREIGN PATENT DOCUMENTS

| | | |
|---|---|---|
| JP | 2014-127429 | 7/2014 |

*Primary Examiner* — Edwin A. Leon
*Assistant Examiner* — Milagros Jeancharles
(74) *Attorney, Agent, or Firm* — Gerald E. Hespos; Michael J. Porco; Matthew T. Hespos

(57) ABSTRACT

A connector (1) includes connector terminals (2), an insertion portion (3) having the connector terminals (2) inserted therethrough, a first mounting portion 4A formed on a first side of the insertion portion (3), and a second mounting portion (4B) formed on a second side of the insertion portion (3). The second mounting portion (4B) is mounted on an outer periphery of a second female connector (5B) via a sealing member (41) for waterproofing. A first material constituting the first mounting portion (4A) and a second material constituting the second mounting portion (B) are different materials. The second material has higher adhesion to the sealing member (41) than the first material when being kept in contact with the sealing member (41) in a heated environment.

14 Claims, 6 Drawing Sheets

(56) References Cited

U.S. PATENT DOCUMENTS

| | | | | |
|---|---|---|---|---|
| 2015/0288094 | A1* | 10/2015 | Lerner | H01R 13/005<br>439/521 |
| 2016/0294103 | A1* | 10/2016 | Yoshigi | H01R 43/005 |
| 2018/0019544 | A1* | 1/2018 | Ishibashi | H02K 5/22 |
| 2019/0036415 | A1* | 1/2019 | Kataoka | H02K 3/522 |

* cited by examiner

CONNECTOR

BACKGROUND

Field of the Invention

The invention relates to a connector for relaying electrical wiring.

Related Art

A connector for relaying electrical wiring is used in various machine parts when an electronic control part and a control device are electrically wired. Some connectors are arranged in an environment with a possibility of contacting liquid, such as water or oil. A sealing member, such as an O-ring, may be used to prevent liquid from entering connector terminals in the connector from a mounting portion of the connector where another connector is mounted.

For example, oil (automatic transmission oil) is used for the lubrication, operation and the like of each constituent part in a machine part such as an automatic transmission of an automotive vehicle. Japanese Unexamined Patent Publication No. 2014-127429 discloses a connector used in an automatic transmission. The connector includes a sealing member for preventing oil from leaking to the outside of the automatic transmission.

A male connector used in an automatic transmission includes a first mounting portion to be arranged in an oil environment where the male connector possibly contacts oil and a second mounting portion to be arranged in an air environment where the male connector may be wetted. Ends of connector terminals inserted into the male connector are arranged respectively inside tubular mounting portions. Female connectors are mounted respectively in each mounting portion, and wiring is connected to conduction terminals of each female connector. The wiring is connected electrically by the connector terminals.

A male connector and a female connector used in an automatic transmission arrange a sealing member for waterproofing between the inner periphery of the second mounting portion in the air environment and the outer periphery of the female connector. This sealing member prevents water from entering to the connector terminals in the second mounting portion from a clearance between the second mounting portion and the female connector.

The sealing member for waterproofing is sandwiched between the inner periphery of the second mounting portion and the outer periphery of the female connector while being resiliently deformed. Thus, the resiliently deformed sealing member exerts a reaction force on the second mounting portion. Further, each part of the connector thermally expands when the connector is exposed to a high-temperature environment. Thus, the tubular second mounting portion becomes larger, and a reaction force generated by the sealing member can separate the second mounting portion from the sealing member, thereby reducing the waterproofing capabilities of the connector.

Oil in the automatic transmission reaches a maximum temperature of about 150° and the connector used in the automatic transmission is required to have heat resistance and oil resistance. Thus, the selection of resin capable of suppressing a reduction of waterproofness while satisfying requested heat resistance and oil resistance is desired for the connector.

Japanese Unexamined Patent Publication No. 2014-127429 does not solve problems of reduced waterproofing capabilities of a sealing member of a connector.

The invention was developed in view of such a problem and aims to provide a connector capable of maintaining waterproof performance required for a second mounting portion over a long period while maintaining performance such as heat resistance required for a first mounting portion.

SUMMARY

One aspect of the invention is directed to a connector with an insertion portion and connector terminals inserted through the insertion portion. A first mounting portion has a tubular shape and surrounds a first end part of each of the connector terminals projecting from a first side of the insertion portion. A second mounting portion has a tubular shape and surrounds the second end parts of the connector terminals projecting from the second side of the insertion portion. The second mounting portion is mounted on an outer periphery of a female connector provided with conduction terminals to be connected conductively to the second end parts of the connector terminals via a sealing member for waterproofing. A first material of the first mounting portion and a second material of the second mounting portion are different materials, and the second material has higher adhesion than the first material to the sealing member when kept in contact with the sealing member in a heating environment.

The connector satisfies different properties required for the first and second mounting portions by making the materials of the first and second mounting portions to be arranged in different use environments different.

The second mounting portion may be mounted on the outer periphery of the female connector via the sealing member for waterproofing. The sealing member prevents water from entering a clearance between the inner periphery of the second mounting portion and the outer periphery of the female connector to the other end parts of the connector terminals. However, it has been found that waterproof performance by the sealing member might be reduced if the connector is used for a long time in a heated environment. One of reasons for this reduction in waterproof performance was found to be the influence of the separation of the second mounting portion from the sealing member by receiving a reaction force of the resiliently deformed sealing member when the second mounting portion thermally expands.

Accordingly, in the connector of one aspect of the invention, the adhesion of the second material of the second mounting portion to the sealing member in the case of long-term use in a heated environment is made higher than that of the first material of the first mounting portion to the sealing member. In this way, even if the second mounting portion thermally expands, the second mounting portion can easily adhere to the sealing member. Thus, sealing performance between the inner periphery of the second mounting portion and the outer periphery of the female connector can be maintained and waterproofness in the second mounting portion of the connector can be maintained.

Therefore, waterproof performance required for the second mounting portion can be maintained over a long period while performance such as heat resistance required for the first mounting portion is maintained.

"Adhesion" means a property of making the sealing member made of rubber, resin or the like and the material constituting each mounting portion difficult to separate from each other by adhering or being attached under the influence of heat. When an external force for separating the female connector from the second mounting portion is applied, the adhesion can be confirmed by the magnitude of the external force when these components are separated. The higher the adhesion between the sealing member and the second mounting portion, the larger the external force when the female connector and the second mounting portion are separated.

The connector can be a connector assembly with a first female connector mounted in the first mounting portion and a second female connector mounted in the second mounting portion. More particularly, the connector assembly can be connected to a connector assembly with a first male connector including first connector terminals and a first mounting portion formed into a tubular shape to surround the first connector terminals, a second male connector including second connector terminals and a second mounting portion formed into a tubular shape to surround the second connector terminals, and a female connector including a first connector portion to be mounted into the first mounting portion, a second connector portion to be mounted into the second mounting portion and conduction terminals continuously arranged in the first and second connector portions and to be conductively connected to the first connector terminals and the second connector terminals. The second mounting portion may be mounted on an outer periphery of the second connector portion via a sealing member for waterproofing. A first material constituting the first and second connector portions and a second material constituting the second mounting portion are different materials, and the second material has higher adhesion to the sealing member when kept in contact with the sealing member in a heated environment than the first material.

The second mounting portion of the second male connector may be mounted on the outer periphery of the second connector portion of the female connector via the sealing member for waterproofing. This sealing member prevents water from entering the second connector terminals and the conduction terminals via a clearance between the inner periphery of the second mounting portion and the outer periphery of the second connector portion. However, the second mounting portion of the second male connector is thought to separate from the sealing member by receiving a reaction force by the resiliently deformed sealing member when the second mounting portion thermally expands.

Accordingly, the adhesion of the second material of the second mounting portion to the sealing member in the case of long-term use in a heated environment is made higher than the adhesion of the first material of the first and second connector portions to the sealing member. In this way, even if the second mounting portion thermally expands, the second mounting portion can easily adhere to the sealing member. Thus, sealing performance between the inner periphery of the second mounting portion and the outer periphery of the second connector portion can be maintained, and waterproofing performance in the second mounting portion and the second connector portion of the connector assembly can be maintained.

Accordingly, waterproof performance required for the second mounting portion and the second connector portion can be maintained over a long period while performance such as heat resistance required for the first mounting portion and the first connector portion is maintained.

DETAILED DESCRIPTION

Figure 1:
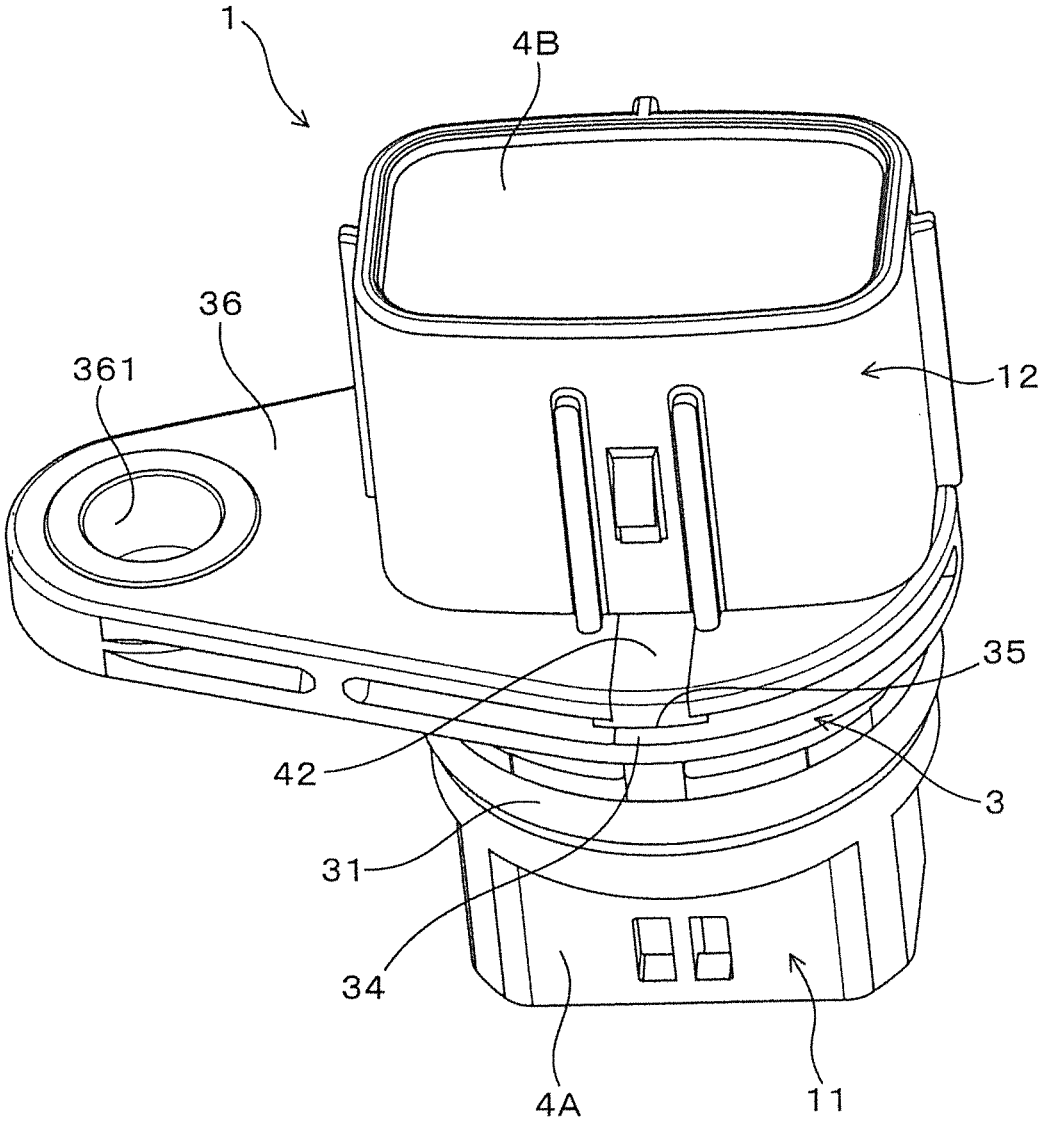
FIG. 1 is a perspective view of a connector according to an embodiment.
Figure 2:
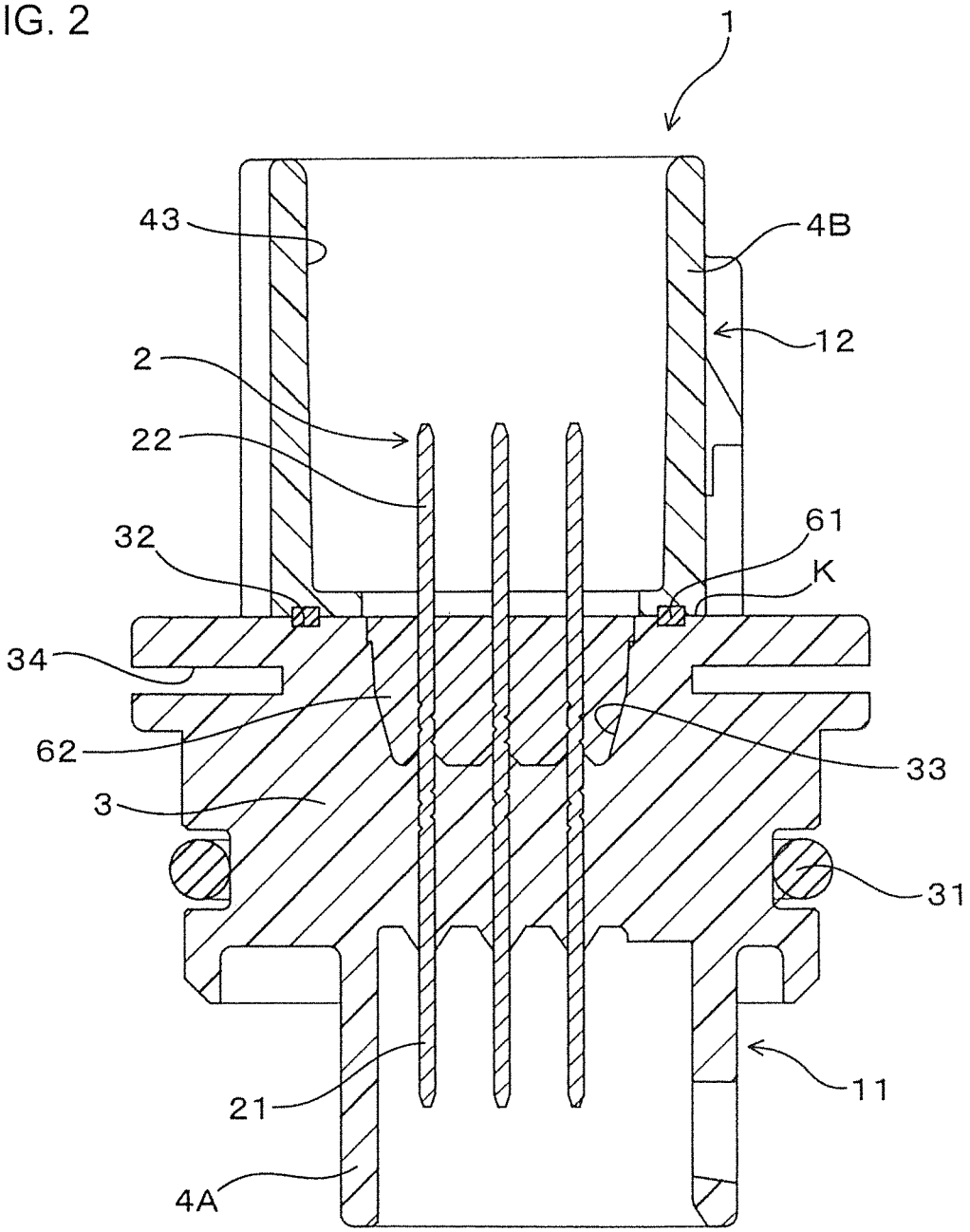
FIG. 2 is a section of the connector according to the embodiment.

An embodiment of the connector described above is described with reference to the drawings. As shown in FIGS. 1 and 2, a connector 1 of this embodiment includes connector terminals 2, an insertion portion 3 having the connector terminals 2 inserted therethrough, a first mounting portion 4A formed on one side of the insertion portion 3 and a second mounting portion 4B formed on the other side of the insertion portion 3. The insertion portion 3 is formed between the first and second mounting portions 4A, 4B. The first mounting portion 4A is formed into a tubular shape to surround a first end part 21 of each of the connector terminals 2 projecting from the insertion portion 3. The second mounting portion 4B is formed into a tubular shape to surround a second end part 22 of each of the connector terminals 2 projecting from the insertion portion 3.

Figure 3:
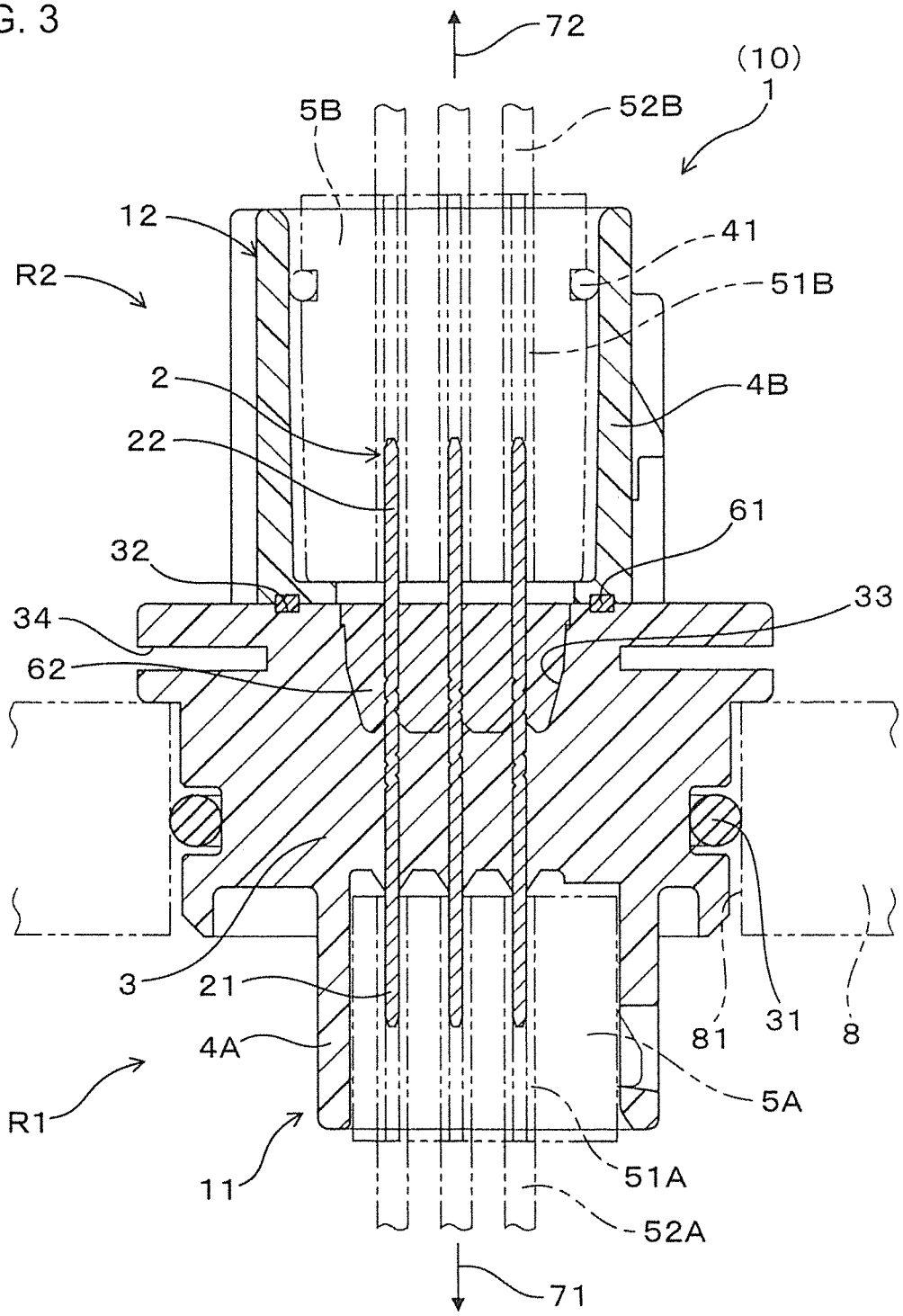
FIG. 3 is a section showing a state where the connector according to the embodiment is used as a connector assembly.

As shown in FIG. 3, the connector 1 of this embodiment is a male connector. A first female connector 5A is mounted into the first mounting portion 4A and a second female connector 5B is mounted into the second mounting portion 4B. Conduction terminals 51A to be conductively connected to the one end part 21 of each of the plurality of connector terminals 2 are provided in the first female connector 5A. Conduction terminals 51B are provided in the second female connector 5B and are to be conductively connected to the second end parts 22 of the plurality of connector terminals 2. The first mounting portion 4A is configured to be mounted on the outer periphery of the first female connector 5A. The second mounting portion 4B is configured to be mounted on the outer periphery of the second female connector 5B via a sealing member 41 for waterproofing. In FIG. 3, the respective female connectors 5A, 5B and conduction terminals 51A, 51B are shown schematically.

A first material constituting the first mounting portion 4A and a second material constituting the second mounting portion 4B are different materials. The second material has higher adhesion to the sealing member 41 when being kept in contact with the sealing member 41 in a heated environment than the first material.

The connector 1 of this embodiment is described in detail below.

As shown in FIG. 3, the connector 1 of this embodiment is used as a relay connector for relaying electrical wiring when an electronic control device 71 and a control device 72 are electrically wired. The electronic control device 71 can be mounted in various machine parts. The machine part of this embodiment is an automatic transmission mounted in an automotive vehicle, and the electronic control device 71 is an actuator such as a motor or a sensor such as a resolver used in the automatic transmission. The electronic control device 71 is electrically connected to an electronic control unit (ECU) as the control device 72 via the plurality of connector terminals 2 of the connector 1.

In the automatic transmission, oil (automatic transmission oil) is used for a control operation of the automatic transmission, lubrication between constituent parts and the like. The connector 1 is arranged in an arrangement hole 81 provided in a case 8 of the automatic transmission. A sealing member 31 for oil to be held in contact with the inner periphery of the arrangement hole 81 is mounted on the outer periphery of the insertion portion 3 of the connector 1. The sealing member 31 is arranged in the groove portion 811 formed in the outer periphery of the insertion portion 3. The oil in the case 8 is prevented from leaking to outside through a clearance between the connector 1 and the arrangement hole 81 by the sealing member 31 for oil.

Further, as shown in FIG. 1, an attaching portion 36 for attaching the connector 1 to the case 8 is provided to project on the outer periphery of the insertion portion 3 of the connector 1. The attaching portion 36 is provided with an attachment hole 361 through which a bolt or the like is to be inserted.

As shown in FIG. 3, when the connector 1 is arranged in the arrangement hole 81, the first mounting portion 4A is arranged in the case 8 of the automatic transmission and the second mounting portion 4B projects from the arrangement hole 81 to be arranged outside the case 8. Further, the first mounting portion 4A and the first female connector 5A are arranged in an oil environment R1 where these possibly contact the oil, and the second mounting portion 4B and the second female connector 5B are arranged in an air environment R2 separated from the oil environment R1 by the sealing member 31 for oil. The air environment R2 also becomes an environment with a possibility of wetting.

The first female connector 5A and the electronic control device 71 are connected by first wires 52A linked to the conduction terminals 51A of the first female connector 5A in the oil environment R1. The second female connector 5B and the control device 72 are connected by second wires 52B linked to the conduction terminals 51B of the second female connector 5B in the air environment R2. Note that the second female connector 5B may be directly mounted on a control board of the control device 72 without via the second wires 52B.

Further, the electronic control device 71 may be a spool valve of a valve body of the automatic transmission. Further, the machine part may be one of various machine parts other than the automatic transmission. Further, the connector 1 may be mounted on the automatic transmission via a bracket and so arranged in the arrangement hole 81 of the case 8 of the automatic transmission as to loosely move with respect to the bracket.

Figure 4:
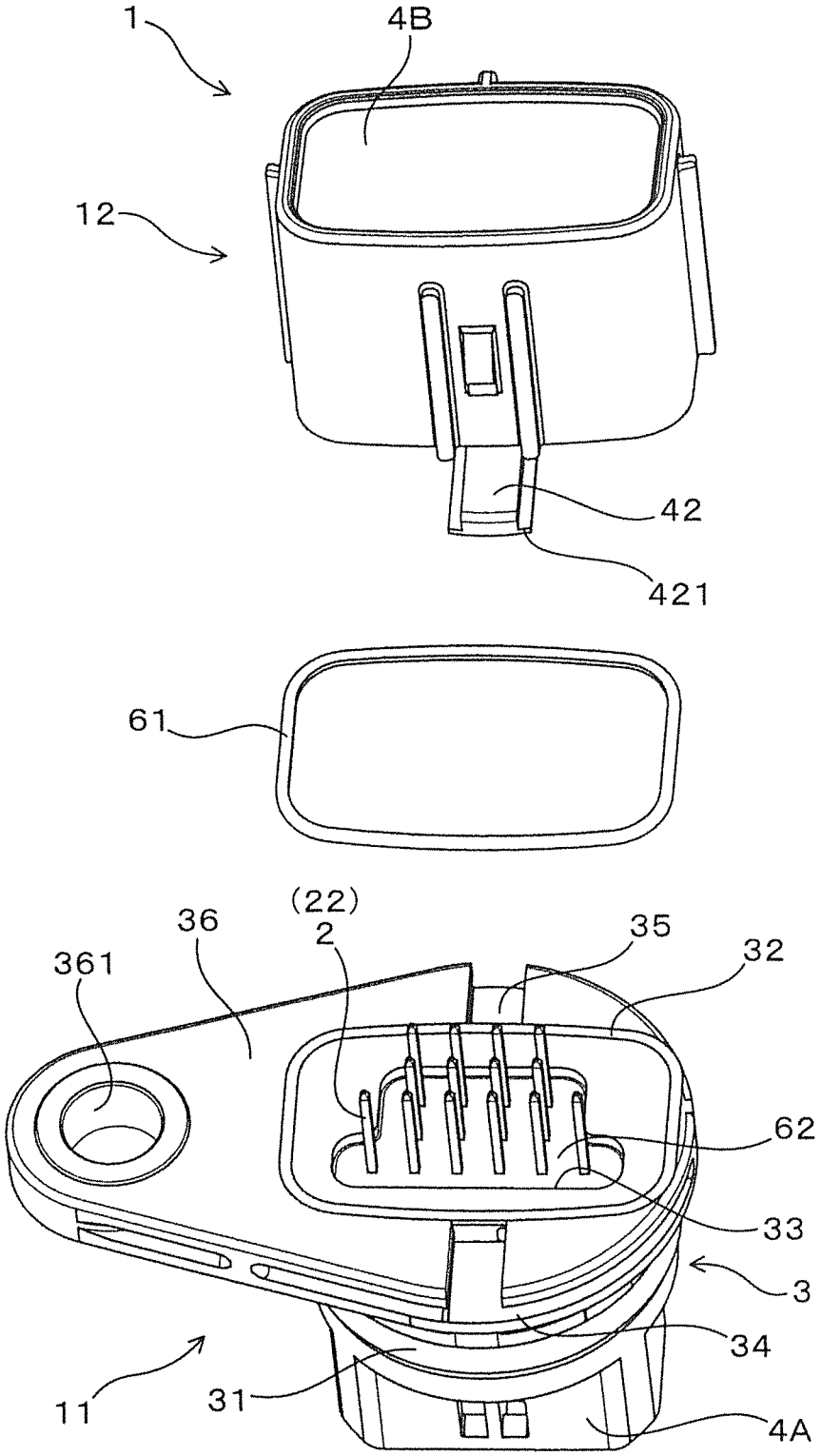
FIG. 4 is a perspective view showing a state where the connector according to the embodiment is broken down into a first material constituting portion, a second material constituting portion and an adhesive member.

As shown in FIG. 4, the insertion portion 3 of this embodiment is made of the same first material as the first mounting portion 4A. The insertion portion 3 and the first mounting portion 4A are formed by resin molding using the first material. The insertion portion 3 and the first mounting portion 4A made of the first material and the second mounting portion 4B made of the second material may be formed as the connector 1 as a signal component by insert molding or two-color molding.

The connector 1 includes a first material constituting portion 11 composed of the insertion portion 3 and the first mounting portion 4A made of the first material, and a second material constituting portion 12 composed of the second mounting portion 4B made of the second material. In other words, each of the first and second material constituting portions 11, 12 can be regarded as a resin molded article. The connector 1 can be regarded as an integral assembly of two molded articles.

As shown in FIG. 3, the connector 1, the first female connector 5A mounted in the first mounting portion 4A of the connector 1 and the second female connector 5B mounted in the second mounting portion 4B of the connector 1 constitute a connector assembly 10. A set of the connector 1, the first female connector 5A and the second female connector 5B is handled as the connector assembly 10.

As shown in FIGS. 1 and 2, each of the first and second mounting portions 4A, 4B is formed into a substantially rectangular tube shape with four curved corner parts. A flat surface 43 to be held in contact with the entire periphery of the sealing member 41 for waterproofing is formed on the inner periphery of the second mounting portion 4B.

As shown in FIG. 3, the sealing member 41 for waterproofing is formed of a resiliently deformable material into an annular shape. The sealing member 41 of this embodiment is made of silicone rubber. The sealing member 41 is mounted on the outer periphery of the second female connector 5B. The sealing member 41 is sandwiched between the inner periphery of the second mounting portion 4B and the outer periphery of the second female connector 5B while being resiliently deformed. A reaction force acts on the second mounting portion 4B from the resiliently deformed sealing member 41, and the sealing member 41 and the second mounting portion 4B are sealed by this reaction force. The sealing member 41 may be made of rubber other than silicone rubber or resin if this is a material resiliently deformable and having higher adhesion to the second material than the first material.

The first material constituting the first mounting portion 4A and the insertion portion 3 of this embodiment is synthetic resin containing glass fibers. The first material of this embodiment contains polyamide resin (PA66 resin), glass fibers and other additives to enhance heat resistance and oil resistance. The content of the glass fibers in the first material is 33 mass %. The content of the glass fibers can be appropriately changed. The glass fibers are mixed in the entire polyamide resin.

The second material constituting the second mounting portion 4B of this embodiment is synthetic resin containing no glass fiber. The second material of this embodiment contains polybutylene terephthalate resin (PBT resin) and other additives to maintain heat resistance and enhance waterproofness.

By the study of the inventor, it was found that polybutylene terephthalate resin had higher adhesion to silicone rubber when being kept in contact with the silicone rubber serving as the sealing member 41 in a high-temperature environment than polyamide resin. This adhesion is observed as a state where both the silicone rubber and the polybutylene terephthalate resin adhere to each other by the alteration of at least one of the silicone rubber and the polybutylene terephthalate resin. The silicone rubber and the polybutylene terephthalate resin are also thought to adhere to each other, accompanied by chemical bonding.

Adhesion between the sealing member 41 and the second mounting portion 4B is thought to be enhanced by the alteration of at least one of the first material constituting the sealing member 41 and the second material constituting the second mounting portion 4B by being heated. Heat resistance, weather resistance, water resistance and the like of the silicone rubber constituting the sealing member 41 are known to be higher than those of other general rubbers.

By using the silicone rubber for the sealing member 41, waterproofness between the second mounting portion 4B and the second female connector 5B can be maintained high. Further, in the connector 1 of this embodiment, sealing performance between the sealing member 41 and the second mounting portion 4B by the silicone rubber is enhanced by intentionally altering at least one of the silicone rubber and the second material.

Adhesion means a property of making the second female connector 5B and the second mounting portion 4B difficult to separate when an external force for separating the second female connector 5B and the second mounting portion 4B is applied between the both. In other words, when an external force for separating the second female connector 5B from the second mounting portion 4B is applied to the both, adhesion between the sealing member 41 and the second mounting portion 4B is said to be higher as the magnitude of the external force when the second female connector 5B is separated from the second mounting portion 4B becomes larger. The sealing member 41 and the second mounting portion 4B need not necessarily have a property of adhering to each other in a high-temperature environment and only have to have a property of attaching to each other in a high-temperature environment.

Further, heat resistance and oil resistance of a material are improved by mixing glass fibers into synthetic resin. The second material is thought to have high adhesion to the sealing member 41 made of the silicone rubber in a high-temperature environment since including no glass fiber. The second material may contain a smaller amount of glass fibers than the first material. If the second material contains glass fibers, the content of the synthetic resin in the second material decreases and adhesion to the silicone rubber is thought to be reduced as compared to the case where no glass fiber is contained.

The compositions of the first and second materials of this embodiment are exemplary. Various types of synthetic resin having high resistance and oil resistance can be used as the first material. Further, various types of synthetic resin having good adhesion to the silicone rubber can be used as the second material.

Further, the first and second materials can be both made of synthetic resin containing no glass fiber. In this case, the adhesion of synthetic resin constituting the second material to the silicone rubber is made higher than that of synthetic resin constituting the first material to the silicone rubber.

Further, the heat resistance of the second material of the second mounting portion 4B is lower than that of the first material of the first mounting portion 4A and the insertion portion 3. Here, heat resistance means a property of making a property change unlikely to occur even if the material is exposed for a long time in a heating environment. The second mounting portion 4B is not arranged in the oil environment R1 serving as a heating source, and is less heated than the first mounting portion 4A. Thus, the heat resistance of the second material can be made lower than that of the first material.

The second mounting portion 4B arranged in the air environment R2 while the heat resistance of the first mounting portion 4A arranged in the oil environment R1 is maintained can enhance adhesion to the sealing member 41 when being exposed to the heating environment for a long time by making the heat resistance thereof lower than that of the first mounting portion 4A. In this way, the heat resistance of the first mounting portion 4A and the insertion portion 3 occupying most part of the connector 1 is maintained by the first material, and adhesion to the sealing member 41 due to compatibility is improved only for the second mounting portion 4B even if heat resistance is slightly reduced.

As shown in FIGS. 2 and 4, an adhesive member 61 is provided on the entire periphery of an interface K between the insertion portion 3 and the second mounting portion 4B surrounding the other end parts 22 of the plurality of connector terminals 2, the interface K being an interface where the first material constituting portion 11 made of the first material and the second material constituting portion 12 made of the second material are joined. Adhesive member recesses 32 in which the adhesive member 61 is to be arranged are formed in an end surface of the insertion portion 3 facing the second mounting portion 4B and an end surface of the second mounting portion 4B facing the insertion portion 3. Note that the adhesive member recess 32 may be formed in either one of the end surface of the insertion portion 3 and the end surface of the second mounting portion 4B.

The adhesive member 61 adheres to the first material constituting portion 11 (first material) and the second material constituting portion 12 (second material) while being arranged in each adhesive member recess 32. The first material and the second material are thought to adhere to each other, accompanied by chemical bonding or the like, on the interface K between the first and second material constituting portions 11, 12. However, it is also supposed that tiny clearances are formed in this interface K due to aging degradation when the interface K is exposed to a heating environment for a long time. Thus, the penetration of water from an outer peripheral side to an inner peripheral side of the connector 1 via the interface K (clearances) on the outer periphery of the connector 1 can be prevented by providing the adhesive member 61 on the interface K between the first and second material constituting portions 11, 12.

The adhesive member 61 can be arranged at a boundary position between the first and second materials when the connector 1 is formed by insert molding or two-color molding using the first and second materials. Further, the connector 1 can also be formed by bonding a molded article made of the first material and a molded article made of the second material by the adhesive member 61.

Note that the insertion portion 3 may be made of the same second material as the second mounting portion 4B. In this case, the interface K between the first and second material constituting portions 11, 12 is formed between the insertion portion 3 and the first mounting portion 4A.

The adhesive member 61 can be made of various materials having good adhesion to the first and second materials. An epoxy-based adhesive using epoxy resin can be used as the adhesive member 61. Further, the adhesive member 61 can be cured by heating, mixing a curing agent or irradiating ultraviolet rays. Further, an adhesive other than epoxy-based adhesive may be used as the adhesive member 61.

Further, as shown in FIG. 2, the insertion portion 3 is provided with a penetration impeding member 62 for impeding the penetration of the oil through interfaces between the plurality of connector terminals 2 and the insertion portion 3 from the first mounting portion 4A toward the second mounting portion 4B. A penetration impeding recess 33 is formed in a surface of the insertion portion 3 on the side of the second mounting portion 4B while entirely surrounding the connector terminals 2. The penetration impeding member 62 is arranged in the penetration impeding recess 33 and in contact with each connector terminal 2 over the entire periphery.

The penetration impeding member 62 has an adhesive function of bonding the insertion portion 3 and the connector terminals 2. The adhesive member 61 and the penetration impeding member 62 can be made of the same adhesive or may be made of different adhesives.

Whether the insertion portion 3 and the attaching portion 36 are formed of the first material or formed of the second material can be selected in consideration of the ease of bonding to the penetration impeding member 62. Specifically, the insertion portion 3 provided with the penetration impeding member 62 can be formed of the material having higher bonding strength to the penetration impeding member 62 out of the first and second materials.

Figure 5:
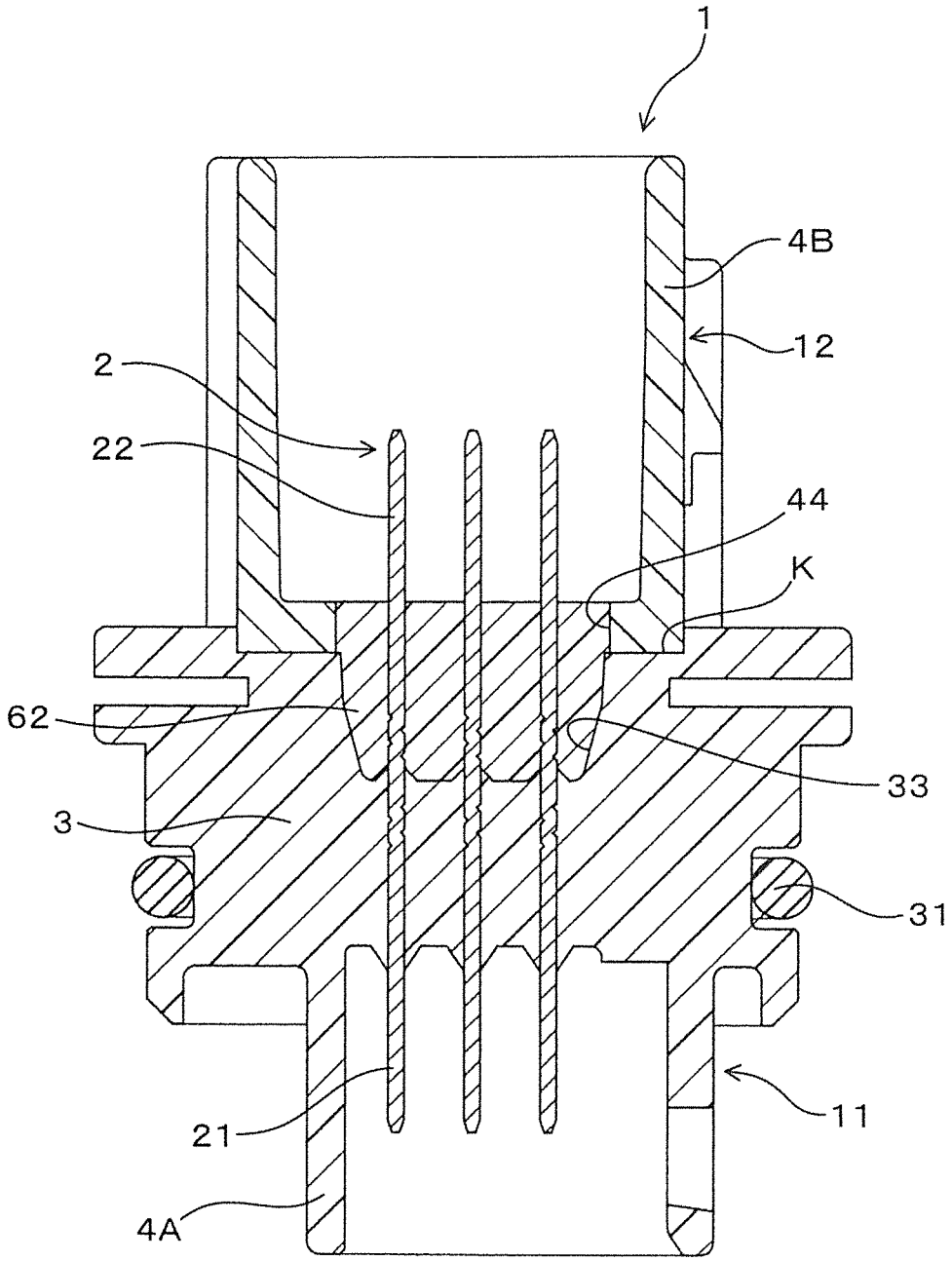
FIG. 5 is a section of another connector according to the embodiment.

Further, the penetration of the oil to the interface K between the first and second material constituting portions 11, 12 can also be impeded by the penetration impeding member 62 in contact with the first and second material constituting portions 11, 12, for example, as shown in FIG. 5. The penetration impeding member 62 can be provided in contact with the penetration impeding recess 33 and an inner peripheral surface 44 of the second mounting portion 4B. In this case, the first and second material constituting portions 11, 12 are bonded by the penetration impeding member 62.

As shown in FIGS. 1 and 4, the connector 1 of this embodiment is formed by combining two types of resin materials, i.e. the first and second materials. The connector 1 has a reinforcing structure for reinforcing bonding strength between the first material constituting portion 11 made of the first material and the second material constituting portion 12 made of the second material. The first and second material constituting portions 11, 12 are formed with locking shapes for preventing the separation of the first and second material constituting portions 11, 12.

As shown in FIG. 4, locking projections 42 project on the end surface of the second mounting portion 4B of the second material constituting portion 12 of this embodiment facing the insertion portion 3. A wide portion 421 wider than a base end part is formed on a tip part of the locking projection 42 on the side of the first mounting portion 4A. Two of the locking projections 42 are formed on wall parts of the tubular second mounting portion 4B facing each other.

As shown in FIGS. 2 and 4, a locking groove 34 recessed toward an inner peripheral side is formed in the outer periphery of the insertion portion 3 of the first material constituting portion 11 of this embodiment. Further, a locking recess 35 is formed by recessing the end surface of the insertion portion 3 facing the second mounting portion 4B. The locking recess 35 communicates with the locking groove 34. The locking projections 42 of the second mounting portion 4B are arranged in the locking recess 35, and the wide portions 421 of the locking projections 42 are locked into the locking groove 34. In this way, the separation of the first and second material constituting portions 11, 12 is prevented mechanically.

Note that the first and second material constituting portions 11, 12 of this embodiment are formed by insert molding or two-color molding as described above. Thus, the locking projections 42 are locked into the locking recess 35 and the locking groove 34 when insert molding or two-color molding is performed.

(Manufacturing Method of Connector 1)

The connector 1 can be manufactured as follows.

First, the plurality of connector terminals 2 are arranged in a first mold, and the molten first material is filled into a first cavity formed in the first mold. Then, the insertion portion 3 having the plurality of connector terminals 2 inserted therethrough and the first material constituting portion 11 including the first mounting portion 4A are molded by the first material filled into the first cavity.

Subsequently, the first material constituting portion 11 is arranged in a second mold, and the adhesive member 61 is arranged in the adhesive member recess 32 in the first material constituting portion 11. Subsequently, the molten second material is filled into a second cavity formed in the second mold. Then, the second mounting portion 4B serving as the second material constituting portion 12 bonded to the insertion portion 3 of the first material constituting portion 11 is molded by the second material filled into the second cavity. Further, the adhesive member 61 is sandwiched between the insertion portion 3 and the second mounting portion 4B. The first and second material constituting portions 11, 12 are integrated into a molded body by resin bonding of the first and second materials and bonding by the adhesive member 61.

Subsequently, the molded body is taken out from the second mold, and the penetration impeding member 62 is injected into the penetration impeding recess 33 of the insertion portion 3 in the molded body. In this way, the connector 1 including the first and second material constituting portions 11, 12 is manufactured. Note that the manufacturing method of this embodiment is exemplary and the connector 1 can be manufactured by various manufacturing methods different from that of this embodiment.

The connector 1 of this embodiment simultaneously satisfies mutually different properties required for the first and second mounting portions 4A, 4B by making the materials of the first and second mounting portions 4A, 4B arranged in different use environments different. When the connector 1 is used, the first mounting portion 4A is arranged in the oil environment R1 where the oil is present and the second mounting portion 4B is arranged in the air environment R2 with a possibility of wetting. The first mounting portion 4A arranged in the oil environment R1 is required to have heat resistance, oil resistance and the like, whereas the second mounting portion 4B arranged in the air environment R2 is required to have waterproofness in addition to heat resistance.

Further, the second mounting portion 4B is mounted on the outer periphery of the second female connector 5B via the sealing member 41 for waterproofing. This sealing member 41 prevents the entrance of water from a clearance between the inner periphery of the second mounting portion 4B and the outer periphery of the second female connector 5B to the other end parts 22 of the plurality of connector terminals 2. However, as a result of the study by the inventor, it was found that waterproofness by the sealing member 41 might be reduced if the connector 1 is used for a long time. One of reasons for this reduction in waterproofness was found to be the influence of the deformation of the tubular second mounting portion 4B to have a larger annular outer shape and the separation of the second mounting portion 4B from the sealing member 41 by receiving a reaction force of the resiliently deformed sealing member 41 when the second mounting portion 4B thermally expands.

The second mounting portion 4B is not required to have oil resistance and is located at a position distant from the oil environment R1 where a high temperature is reached, whereby a level of heat resistance required for the second mounting portion 4B is lower than that required for the first mounting portion 4A. Accordingly, in the connector 1 of this embodiment, the adhesion of the second material of the second mounting portion 4B to the sealing member 41 in the case of long-term use in a heating environment is made higher than that of the first material of the first mounting portion 4A to the sealing member 41.

In this way, even if the second mounting portion 4B thermally expands, the second mounting portion 4B can easily adhere to the sealing member 41, sealing performance between the inner periphery of the second mounting portion 4B and the outer periphery of the second female connector 5B by the sealing member 41 can be maintained and waterproofness in the second mounting portion 4B of the connector 1 can be maintained. A material satisfying required heat resistance and oil resistance can be used as the first material of the first mounting portion 4A, whereas a material satisfying required heat resistance and waterproofness can be used as the second material of the second mounting portion 4B.

Therefore, according to the connector 1 of this embodiment, waterproof performance required for the second mounting portion 4B can be maintained over a long period while heat resistance and oil resistance performance required for the first mounting portion 4A is maintained.

Figure 6:
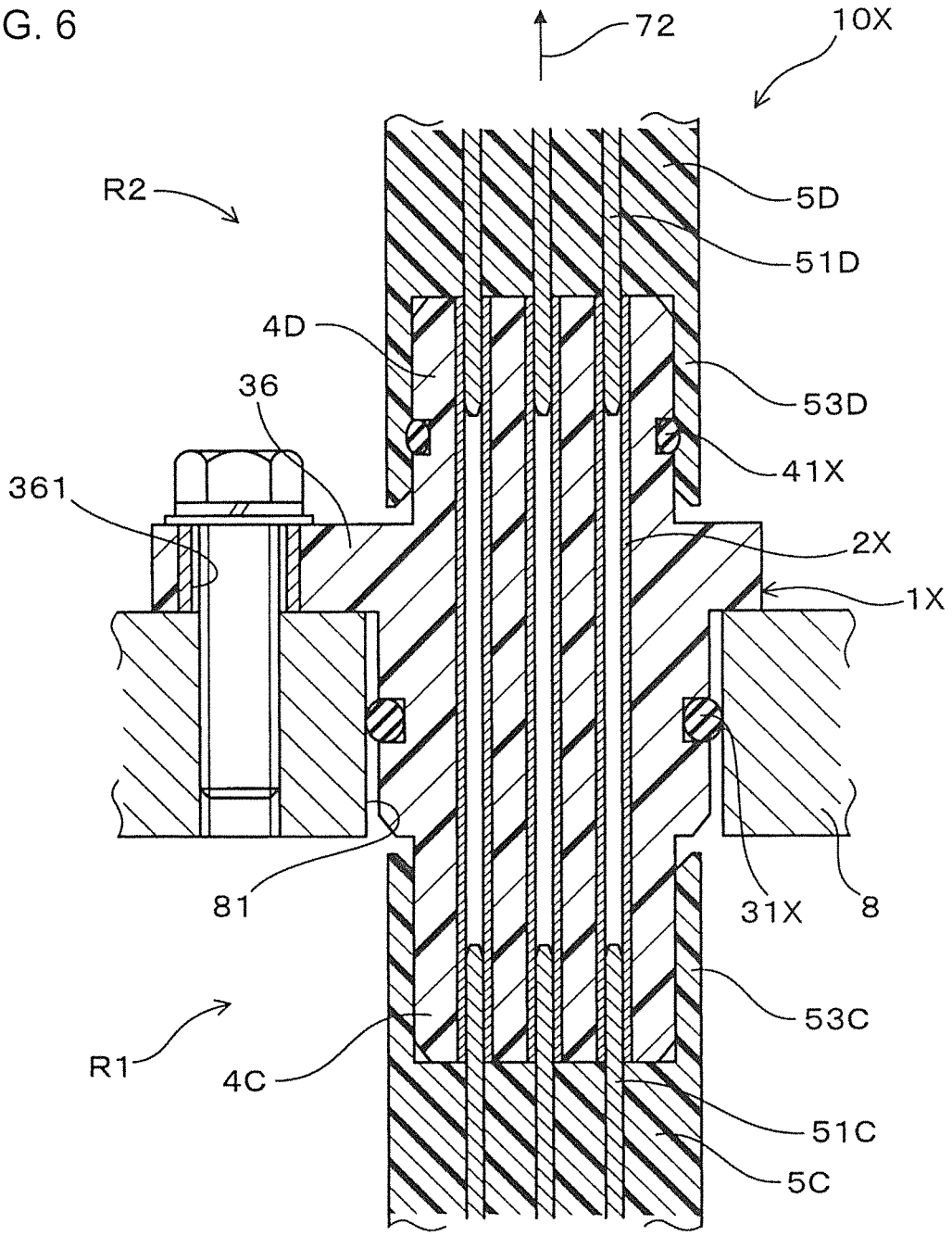
FIG. 6 is a section of a connector assemble according to a reference embodiment.

FIG. 6 illustrates an assembly that comprises a female connector 1X and a first male connector 5C and a second male connector 5D are mounted in the female connector 1X as shown in FIG. 6. In this embodiment, a connector assembly 10X is formed by the first male connector 5C, the second male connector 5D and the female connector 1X. Note that FIG. 6 schematically shows the connector assembly 10X including the female connector 1X.

The first male connector 5C includes first connector terminals 51C and a first mounting portion 53C formed into a tubular shape to surround the first connector terminals 51C. The second male connector 5D includes second connector terminals 51D and a second mounting portion 53D formed into a tubular shape to surround the second connector terminals 51D. The female connector 1X includes a first connector portion 4C to be mounted into the first mounting portion 53C, a second connector portion 4D to be mounted into the second mounting portion 53D and a plurality of conduction terminals 2X continuously arranged in the first and second connector portions 4C, 4D. The plurality of conduction terminals 2X are connected conductively to the first connector terminals 51C and the second connector terminals 51D.

As shown in FIG. 6, the second mounting portion 53D is mounted on the outer periphery of the second connector portion 4D via a sealing member 41X for waterproofing. A first material constituting the first and second connector portions 4C, 4D and a second material constituting the second mounting portion 53D are mutually different materials. The second material has higher adhesion to the sealing member 41X when being kept in contact with sealing member 41X in a heating environment than the first material.

The compositions of the first and second materials in this embodiment are as those shown in the above embodiment. The second mounting portion 53D of the connector 1 of the above embodiment serves as the second mounting portion 53D of the second male connector 5D, and the second female connector 5B of the above embodiment serves as the second connector portion 4D of the female connector 1X.

In this embodiment, when the female connector 1X is arranged in the arrangement hole 81 of the case 8 of the automatic transmission, the first connector portion 4C and the first male connector 5C are arranged in the case 8, the second connector portion 4D and the second male connector 5D project from the arrangement hole 81 to be arranged outside the case 8. The first connector portion 4C and the first male connector 5C are arranged in the oil environment R1 where these possibly contact the oil, and the second connector portion 4D and the second male connector 5D are arranged in the air environment R2 separated from the oil environment R1 by the sealing member 31X for oil mounted on the outer periphery of the first connector portion 4C. The air environment R2 also becomes an environment with a possibility of wetting.

When the connector assembly 10X of this embodiment is used, the first connector portion 4C and the first male connector 5C arranged in the oil environment R1 are required to have heat resistance, oil resistance and the like, whereas the second connector portion 4D and the second male connector 5D arranged in the air environment R2 are required to have waterproofness in addition to heat resistance.

In the connector assembly 10X of this embodiment, the second mounting portion 53D of the second male connector 5D is mounted on the outer periphery of the second connector portion 4D of the female connector 1X via the sealing member 41 for waterproofing. This sealing member 41 prevents the entrance of water from a clearance between the inner periphery of the second mounting portion 53D and the outer periphery of the second connector portion 4D to the plurality of second connector terminals 51D and the plurality of conduction terminals 2X. However, when the tubular second mounting portion 53D of the second male connector 5D thermally expands, it is thought that the second mounting portion 53D is deformed to have a larger annular outer shape and the second mounting portion 53D is going to be separated from the sealing member 41X.

The second mounting portion 53D and the second connector portion 4D are not required to have oil resistance and are located at a position distant from the oil environment R1 where a high temperature is reached, whereby a level of heat resistance required for the second mounting portion 53D and the second connector portion 4D is lower than that required for the first mounting portion 53C and the first connector portion 4C. Accordingly, in the connector 1 of this embodiment, the adhesion of the second material of the second mounting portion 53B to the sealing member 41X in the case of long-term use in a heating environment is made higher than that of the first material of the first and second connector portions 4C and 4D to the sealing member 41.

In this way, even if the tubular second mounting portion 53D thermally expands, the second mounting portion 53D can easily adhere to the sealing member 41X, sealing performance between the inner periphery of the second mounting portion 53D and the outer periphery of the second connector portion 4D by the sealing member 41X can be maintained and waterproofness in the second mounting portion 53D and the second connector portion 4D of the connector assembly 10X can be maintained. A material satisfying required heat resistance and oil resistance can be used as the first material of the first and second connector portions 4C, 4D, whereas a material satisfying required heat resistance and waterproofness can be used as the second material of the second mounting portion 53D.

Therefore, according to the connector assembly 10X of this embodiment, waterproof performance required for the second mounting portion 53D and the second connector portion 4D can be maintained over a long period while heat resistance and oil resistance performance required for the first mounting portion 53C and the first connector portion 4C is maintained.

The other configuration, functions, effects and the like of the connector assembly 10X of this embodiment are the same as in the above embodiment. Further, in this embodiment, components denoted by the same reference signs as in the above embodiment are the same as those in the above embodiment.

The invention is not limited only to each of the above embodiments and can constitute further different embodiments without departing from the gist thereof. Further, the present invention includes various modifications, modifications within the scope of equivalents, and the like.

LIST OF REFERENCE SIGNS

1 connector
11 first material constituting portion
12 second material constituting portion
2 connector terminal
21 first end part
22 second end part
3 insertion portion
31 sealing member for oil
4A first mounting portion
4B second mounting portion
41 sealing member for waterproofing
5A first female connector
5B second female connector
61 adhesive member
R1 oil environment
R2 air environment

What is claimed is:

1. A connector, comprising:

connector terminals;

a first component formed from a first synthetic resin material and including an insertion portion having opposite first and second sides and having the connector terminals inserted therethrough, the first component further having a first mounting portion projecting from the insertion portion, the first mounting portion having a tubular shape and surrounding first end parts of the connector terminals projecting from the first side of the insertion portion; and a second component having a second mounting portion connected to the first side of the insertion portion and formed from a second synthetic resin material, the second mounting portion having a tubular shape and surrounding second end parts of the connector terminals projecting from the second side of the insertion portion;

the second mounting portion being mounted on an outer periphery of a female connector provided with conduction terminals to be conductively connected to the second end parts of the connector terminals via a sealing member for waterproofing;

the first synthetic resin material constituting the first mounting portion and the second synthetic resin material constituting the second mounting portion being different materials; and the second synthetic resin material having an adhesion to the sealing member higher than the first synthetic resin material when being kept in contact with the sealing member in a heating environment.

2. The connector of claim 1, wherein:

the first synthetic resin material is synthetic resin containing glass fibers; and the second synthetic resin material is synthetic resin containing less glass fibers than the first synthetic resin material or synthetic resin synthetic resin material containing no glass fiber.

3. The connector of claim 1, wherein heating resistance of the second synthetic resin material is lower than that of the first synthetic resin material.

4. The connector of claim 1, wherein the first mounting portion is arranged in an oil environment where the first mounting portion may contact oil, and the second mounting portion is arranged in an air environment separated from the oil environment by a sealing member mounted on an outer periphery of the insertion portion.

5. The connector of claim 4, wherein:

the first synthetic resin material contains polyamide resin and glass fibers;

the second synthetic resin material contains polybutylene terephthalate resin; and the sealing member is made of silicone rubber.

6. The connector of claim 1, wherein:

the insertion portion is made of the first or second synthetic resin material; and an adhesive member is provided over the entire periphery of an interface to surround the plurality of connector terminals, a first material constituting portion made of the first synthetic resin material and a second material constituting portion made of the second synthetic resin material being joined at the interface.

7. The connector of claim 6, wherein the first material constituting portion made of the first synthetic resin material and the second material constituting portion made of the second synthetic resin material are formed with locking shapes for preventing the separation of the first and second material constituting portions.

8. The connector of claim 1, wherein the second side of the insertion portion includes a penetration impeding recess surrounding the connector terminals, and a penetration impeding member arranged in the penetration impeding recess and in sealing contact with the insertion portion and each of the connector terminals.

9. The connector of claim 8, wherein the penetration impeding member further is in sealing contact with surfaces of the second mounting portion adjacent the first mounting portion and surrounding the connector terminals, wherein the penetration impeding member bonds in the first and second components to one another.

10. The connector of claim 1, further comprising locking projections projecting out from the second mounting portion, the locking projections being at least partly surrounded by the first synthetic resin material of the first component.

11. The connector of claim 1 wherein the first synthetic resin material of the insertion portion is molded to the connector terminals.

12. The connector of claim 1, wherein the second mounting portion is connected adhesively to the first side of the insertion portion.

13. The connector of claim 1 wherein the second mounting portion is molded into engagement with the second side of the insertion portion.

14. A connector, comprising:

connector terminals with opposite first and second end parts;

a first component formed from a first synthetic resin material and including an insertion portion having opposite first and second sides and being molded into sealing engagement around parts of the connector terminals between the first and second end parts, the second side of the insertion portion including a penetration impeding recess surrounding the connector terminals, the first component further having a first mounting portion projecting from the insertion portion, the first mounting portion having a tubular shape and surrounding first end parts of the connector terminals projecting from the first side of the insertion portion;

a penetration impeding member arranged in the penetration impeding recess and in sealing contact with the insertion portion and each of the connector terminals;

a second component having a second mounting portion connected to the first side of the insertion portion and formed from a second synthetic resin material, the second mounting portion having a tubular shape and surrounding second end parts of the connector terminals projecting from the second side of the insertion portion;

the second mounting portion being mounted on an outer periphery of a female connector provided with conduction terminals to be conductively connected to the second end parts of the connector terminals via a sealing member for waterproofing;

the first synthetic resin material constituting the first mounting portion and the second synthetic resin material constituting the second mounting portion being different materials; and the second synthetic resin material having an adhesion to the sealing member higher than the first synthetic resin material when being kept in contact with the sealing member in a heating environment.

* * * * *